United States Patent [19]

Bittar et al.

[11] 4,305,479

[45] Dec. 15, 1981

[54] VARIABLE ELEVATOR UP PEAK DISPATCHING INTERVAL

[75] Inventors: Joseph Bittar; Arnold Mendelsohn, both of Simsbury, Conn.

[73] Assignee: Otis Elevator Company, Hartford, Conn.

[21] Appl. No.: 99,394

[22] Filed: Dec. 3, 1979

[51] Int. Cl.[3] ..... B66B 1/20

[52] U.S. Cl. ..... 187/29 R

[58] Field of Search ..... 187/29

[56] References Cited

U.S. PATENT DOCUMENTS 3,256,958 6/1966 Savino et al. ..... 187/29

3,422,928 1/1969 Bruns ..... 187/29

*Primary Examiner*—Gene Z. Rubinson

*Assistant Examiner*—W. E. Duncanson, Jr.

*Attorney, Agent, or Firm*—Robert E. Greenstien

[57] ABSTRACT

A plural elevator system having a group controller for controlling the joint response of a plurality of elevator cars to the needs of a building, employs a microprocessor-based group controller for providing up peak, down peak and other zone-controlled elevator functions. The group controller provides a variable interval between dispatching of elevator cars from the lobby during up peak, the dispatching interval being controlled by the approximate round trip time of an elevator being dispatched from the lobby in serving the car calls registered within it and returning to the lobby, or the average of the approximate round trip time for two or three most recently dispatched elevator cars. The dispatching interval is determined by the approximate round trip time divided by the number of elevator cars serving the up peak traffic. In addition, the dispatching interval can be further reduced in dependence upon the number of cars standing at the lobby, the reduction being greater in case the last car leaving the lobby is not more than half full than in the case when the last car leaving the lobby is more than half full. Exemplary elevator and microprocessor structure, an overall group controller microprocessor program logic flowchart, illustrative of the environment of the invention, and detailed logic flowcharts illustrative of an embodiment of the invention are disclosed.

5 Claims, 12 Drawing Figures

| SPD UP | NBR CRS LOB | SPD UP |
|---|---|---|
| 0 | 1 | 0 |
| 5 | 2 | 7 |
| 10 | 3 | 13 |
| 15 | 4 | 18 |
| 20 | 5 or more | 23 |

VARIABLE ELEVATOR UP PEAK DISPATCHING INTERVAL

DESCRIPTION

Technical Field

This invention relates to elevator systems, and more particularly to controlling the interval at which cars are dispatched during up peak traffic conditions in a group controlled, multi-elevator system.

Background Art

Most multi-elevator systems in which a plurality of cars service a plurality of landings, including a common main landing, such as a lobby, employ a group controller which controls the operation of the elevator cars in servicing the elevator needs of the building. In such systems, it has been commonly known to employ means for detecting up peak traffic conditions, such as may obtain at the start of a normal working day, either by means of a clock, a lobby control key, or the frequency and load of service provided upwardly from the lobby by the cars themselves, or a combination of them. In an up-peak mode of operation, the group controller dispatches the elevators from the lobby at intervals so as to not only provide rapid service to the passengers already in the cars and provide available cars to future passengers entering the building by means of the lobby floor, but also to provide, when up peak traffic conditions prevent normal zone-control over the answering of calls at other landings in the building, a steady supply of cars traveling upward and back through the building so as to handle any necessary calls. If the dispatching interval is too short, cars will be dispatched before they contain as many passengers as they might, and future passengers will have to wait at the lobby for the return of additional cars before they can move upwardly through the building. On the other hand, if the dispatching interval is too long, passengers are caused to wait unduly in the cars while standing at the lobby before being dispatched, and the cars are not moved freely through the building at a rapid enough rate to service such other calls as may occur during the upward and downward travel of the cars on up peak traffic condition control.

Disclosure of Invention

Objects of the invention include the provision of a variable up peak dispatching interval for a group-controlled elevator system.

According to the present invention, an elevator system of the type having group-control including an up peak mode of operation operative during up peak traffic conditions, in which cars are forced to service the lobby and are dispatched from the lobby at intervals, examines the car calls registered in each car being dispatched from the lobby in response to up peak traffic conditions, to provide an approximate round trip time for the car to answer the car calls registered in it at the time of dispatch and return to the lobby, and the dispatching interval is controlled in accordance with the approximate round trip time so provided. According further to the invention, the dispatching interval may be controlled in accordance with an average approximate round trip time determined for a plurality of elevators most recently dispatched from the lobby in response to up peak traffic conditions. According still further to the present invention, the dispatching interval is controlled as a function of the approximate round trip time divided by the number of elevators determined to be available to serve the up peak traffic. In accordance further with the present invention, the dispatching interval may be altered as a function of the number of cars at the lobby. In accordance still further with the invention, the reduction of the dispatching interval as a function of the number of cars at the lobby may be different in dependence upon whether the last car which has been dispatched from the lobby has at least a half a load, in which case said dispatching interval is reduced by a lesser amount, for any given number of cars, than if it has not.

The present invention provides a very dynamic way of tailoring the dispatching interval during up peak traffic conditions to the actual conditions appertaining in the building, including the number of stops which the cars are demanded to make before returning to the lobby floor, the number of cars available to service the lobby floor, the loading of the cars, and the number of cars which may have accumulated at the lobby floor. The invention avoids up peak traffic control which has either too short a dispatching interval or too long a dispatching interval. The invention may be practiced in a wide variety of elevator systems, utilizing known technology in the light of the teachings of the invention, which follow hereinafter.

The foregoing and other objects, features and advantages of the present invention will become more apparent in the light of the following detailed description of an exemplary embodiment thereof, as illustrated in the accompanying drawings.

Figure 11:
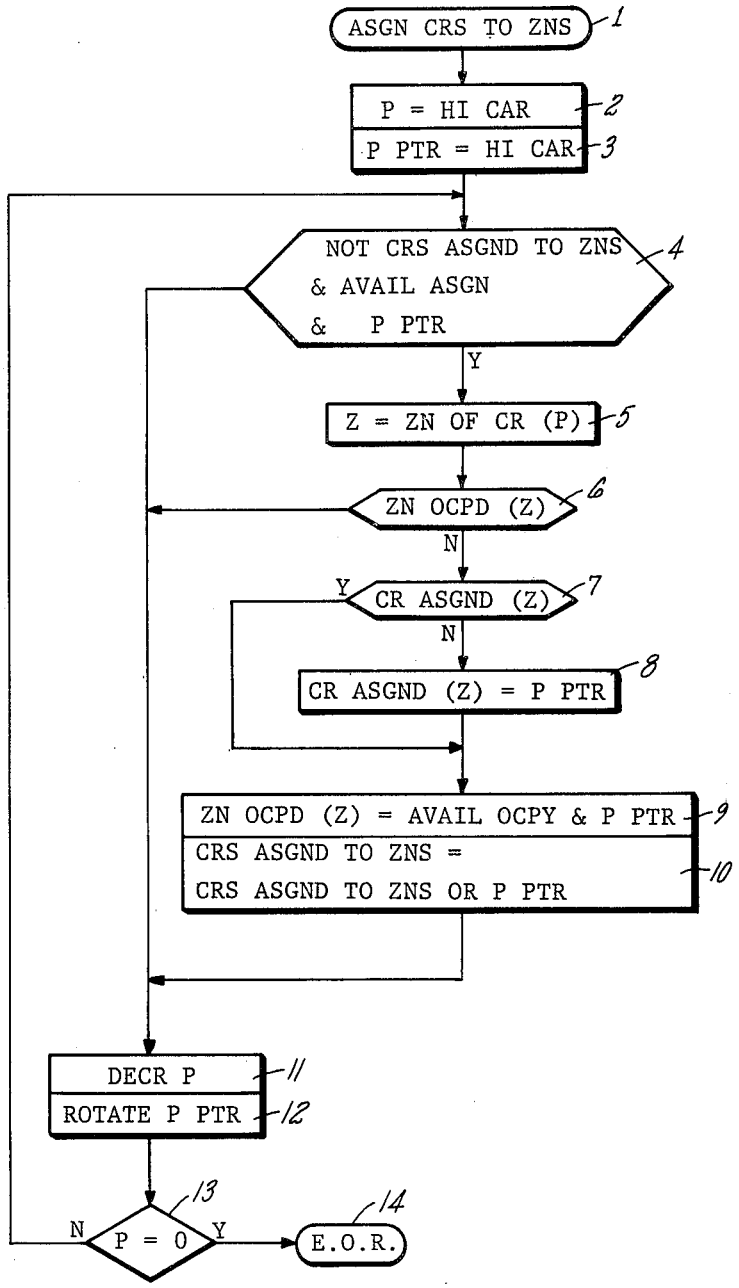

FIG. M10 is a logic flow diagram of a car available routine;

FIG. 11 is a logic flow diagram of an assign cars to zones routine; and

Figure 12:
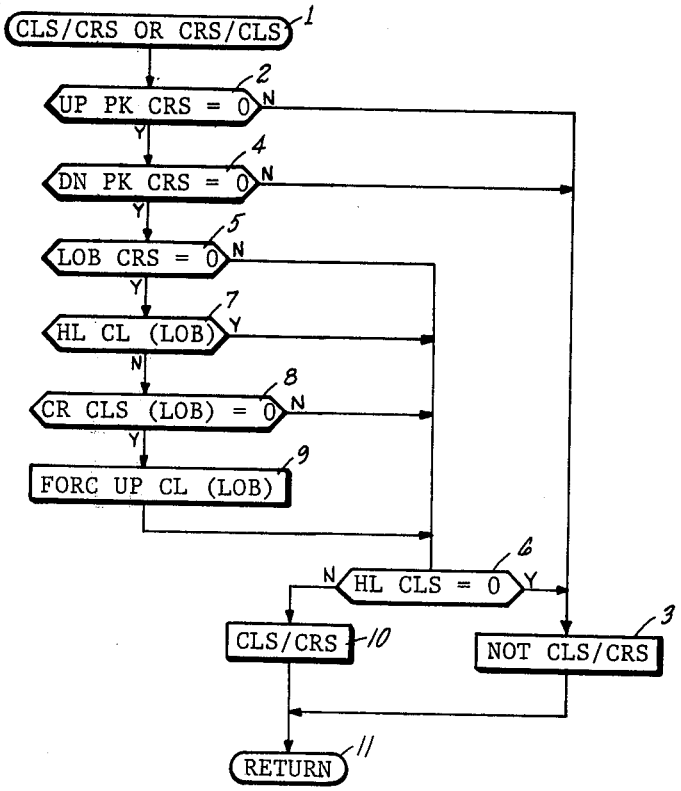

FIG. 12 is a logic flow diagram of a calls-to-cars or cars-to-calls routine.

BEST MODE FOR CARRYING OUT THE INVENTION

Figure 1:
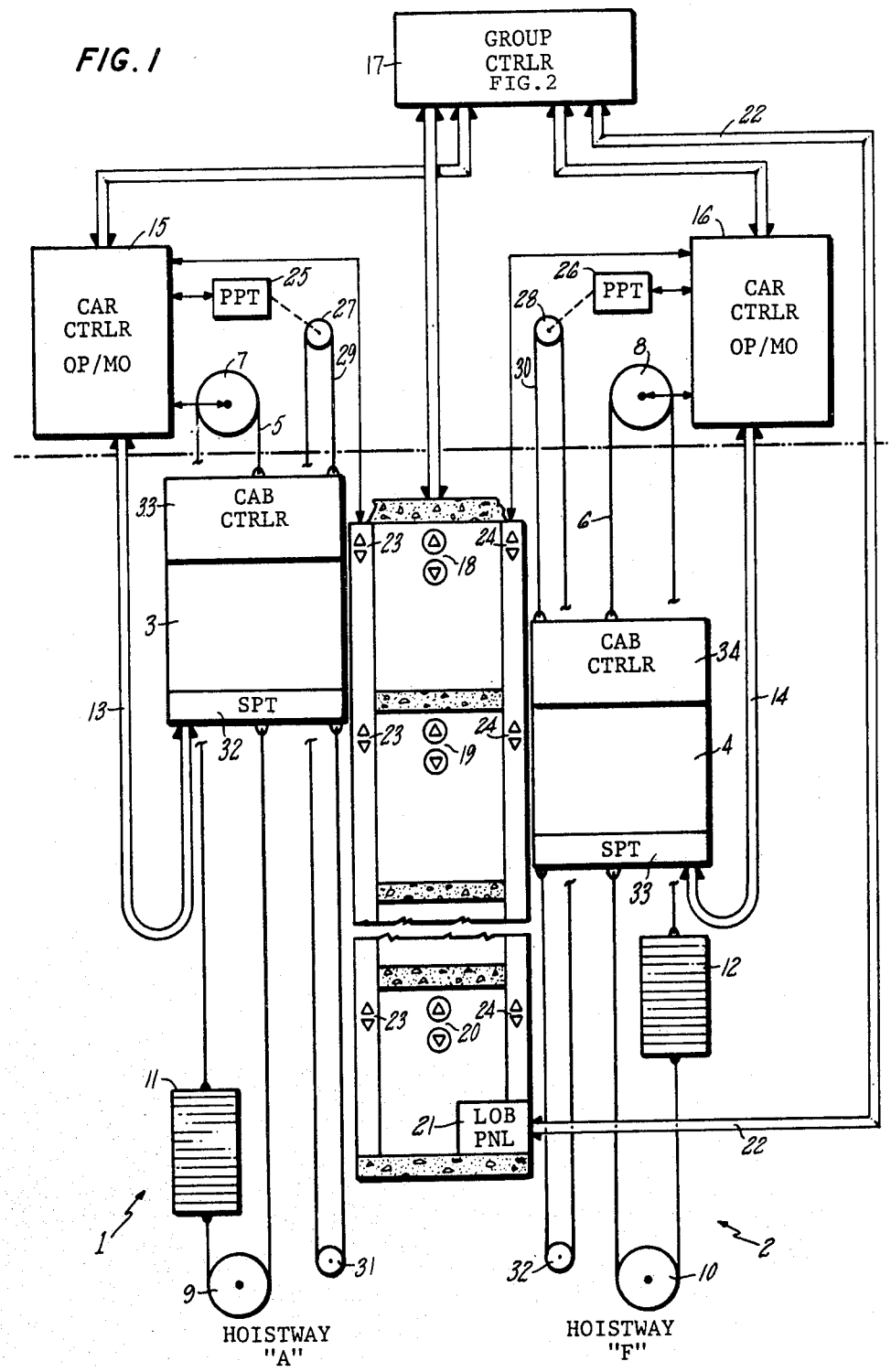
FIG. 1 is a simplified, schematic block diagram, partially broken away, of an elevator system in which the present invention may be incorporated.

A simplified description of a multi-car elevator system, of the type in which the present invention may be practiced, is illustrated in FIG. 1. Therein, a plurality of hoistways, HOISTWAY "A" 1 and HOISTWAY "F" 2 are illustrated, the remainder are not shown for simplicity. In each hoistway, an elevator car or cab 3, 4 is guided for vertical movement on rails (not shown). Each car is suspended on a rope 5, 6 which usually comprises a plurality of steel cables, that is driven either direction or held in a fixed position by a drive sheave/-motor/brake assembly 7, 8, and guided by an idler or return sheave 9, 10 in the well of the hoistway. The rope 5, 6 normally also carries a counterweight 11, 12 which is typically equal to approximately the weight of the cab when it is carrying half of its permissable load.

Each cab 3, 4 is connected by a traveling cable 13, 14 to a corresponding car controller 15, 16 which is located in a machine room at the head of the hoistways. The car controllers 15, 16 provide operation and motion control to the cabs, as is known in the art. In the case of multi-car elevator systems, it has long been common to provide a group controller 17 which receives up and down hall calls registered on hall call buttons 18–20 on the floors of the buildings, allocates those calls to the various cars for response, and distributes cars among the floors of the building, in accordance with any one of several various modes of group operation. Modes of group operation may be controlled in part by a lobby panel 21 which is normally connected by suitable building wiring 22 to the group controller in multi-car elevator systems.

The car controllers 15, 16 also control certain hoistway functions which relate to the corresponding car, such as the lighting of up and down response lanterns 23, 24, there being one such set of lanterns 23 assigned to each car 3, and similar sets of lanterns 24 for each other car 4, designating the hoistway door where service in response to a hall call will be provided for the respective up and down directions.

The foregoing is a description of an elevator system in general, and, as far as the description goes thus far, is equally descriptive of elevator systems known to the prior art, and elevator systems incorporating the teachings of the present invention.

Although not required in the practice of the present invention, the elevator system in which the invention is utilized may derive the position of the car within the hoistway by means of a primary position transducer (PPT) 25, 26 which may comprise a quasi-absolute, incremental encoder and counting and directional interface circuitry of the type described in a commonly owned copending U.S. patent application of Marvin Masel et al, Ser. No. 927,242, filed on July 21, 1978, (a continuation of Ser. No. 641,798, filed Dec. 18, 1975), entitled HIGH RESOLUTION AND WIDE RANGE SHAFT POSITION TRANSDUCER SYSTEMS. Such transducer is driven by a suitable sprocket 27, 28 in response to a steel tape 29, 30 which is connected at both its ends to the cab and passes over an idler sprocket 31, 32 in the hoistway well. Similarly, although not required in an elevator system to practice the present invention, detailed positional information at each floor, for more door control and for verification of floor position information derived by the PPT 25, 26, may employ a secondary position transducer (SPT) 32, 33 of the type disclosed and claimed in a commonly owned copending U.S. application filed on Nov. 13, 1979, by Fairbrother, Ser. No. 093,475. Or, if desired, the elevator system in which the present invention is practiced may employ inner door zone and outer door zone hoistway switches of the type known in the art.

The foregoing description of FIG. 1 is intended to be very general in nature, and to encompass, although not shown, other system aspects such as shaftway saftey switches and the like, which have not been shown herein for simplicity, since they are known in the art and not a part of the invention herein.

All of the functions of the cab itself are directed, or communicated with, by means of a cab controller 33, 34 in accordance with the present invention, and may provide serial, time-multiplexed communications with the car controller as well as direct, hard-wired communications with the car controller by means of the traveling cables 13, 14. The cab controller, for instance, will monitor the car call buttons, door open and door close buttons, and other buttons and switches within the car; it will control the lighting of buttons to indicate car calls, and will provide control over the floor indicator inside the car which designates the approaching floor. The cab controller interfaces with load weighing transducers to provide weight information used in controlling the motion, operation, and door functions of the car. The load weighing may be in accordance with the invention described and claimed in commonly owned copending patent applications filed on Nov. 27, 1979, by Donofrio, Ser. No. 098,004 and by Games, Ser. No. 098,003. A most significant job of the cab controller 33, 34 is to control the opening and closing of the door, in accordance with demands therefore under conditions which are determined to be safe.

The makeup of microcomputer systems, such as may be used in the implementation of the car controllers 15, 16, a group controller 17, and the cab controllers 33, 34, can be selected from readily available components or families thereof, in accordance with known technology as described in various commercial and technical publications. These include "An Introduction to Microcomputers, Volume II, Some Real Products" published in 1977 by Adam Osborne and Associates, Inc., Berkeley, California, U.S.A., and available from Sydex, Paris, France; Arrow International, Tokyo, Japan, L. A. Varah Ltd., Vancouver, Canada, and Taiwan Foreign Language Book Publishers Council, Taipei, Taiwan. And, "Digital Microcomputer Handbook", 1977–1978 Second Edition, published by Digital Equipment Corporation, Maynard, Massachusetts, U.S.A. And, Simpson, W. D., Luecke, G., Cannon, D. L., and Clemens, D. H. "9900 Family Systems Design and Data Book", 1978, published by Texas Instruments, Inc., Houston, Texas, U.S.A. (U.S. Library of Congress Catalog No. 78-058005). Similarly, the manner of structuring the software for operation of such computers may take a variety of known forms, employing known principles which are set forth in a variety of publications. One basic fundamental treatise is "The Art of Computer Programming", in seven volumes, by the Addison-Wesley Publishing Company, Inc., Reading, Massachusetts, and Menlo Park, California, U.S.A.; London, England; and Don Mills, Ontario, Canada (U.S. Library of Congress Catalog No. 67-26020). A more popular topical publication is "EDN Microprocessor Design Series" published in 1975 by Kahners Publishing Company (Electronic Division News), Boston, Massachusettes, U.S.A. And a useful work is Peatman, J. B., "Microcomputer-Based Design" published in 1977 by McGraw Hill Book Company (worldwide), U.S. Library of Congress Catalog No. 76-29345.

The software structures for implementing the present invention, and peripheral features which may be disclosed herein, may be organized in a wide variety of fashions. However, utilizing the Texas Instruments' 9900 family, and suitable interface modules for working there with, an elevator control system of the type illustrated in FIG. S1, with separate controllers for the cabs, the cars, and the group, has been implemented utilizing real time interrupts, power on causing a highest priority interrupt which provides system initialization (above and beyond initiation which may be required in any given function of one of the controllers). And, it has employed an executive program which responds to real time interrupts to perform internal program functions and which responds to communication-initiated interrupts from other controllers in order to process serial communications with the other controllers, through the control register unit function of the processor. The various routines are called in timed, interleaved fashion, some routines being called more frequently than others, in dependence upon the criticality or need for updating the function performed thereby. Specifically, there is no function relating to elevatoring which is not disclosed herein that is not known and easily implemented by those skilled in the elevator art in the light of the teachings herein, nor is there any processor function not disclosed herein which is incapable of implementations using techniques known to those skilled in the processing arts, in the light of the teachings herein.

The invention herein is not concerned with the character of any digital processing equipment, nor is it concerned with the programming of such processor equipment; the invention is disclosed in terms of an implementation which combines the hardware of an elevator system with suitably-programmed processors to perform elevator functions, which have never before been performed. The invention is not related to performing with microprocessors that which may have in the past been performed with traditional relay/switch circuitry nor with hard wired digital modules; the invention concerns new elevator functions, and the disclosure herein is simply illustrative of the best mode contemplated for carrying out the invention, but the invention may also be carried out with other combinations of hardware and software, or by hardware alone, if desired in any given implementation thereof.

Communication between the cab controllers 33, 34, and the car controllers 15, 16 in FIG. 1 is by means of the well known traveling cable in FIG. 1. However, because of the capability of the cab controllers and the car controllers to provide a serial data link between themselves, it is contemplated that serial, time division multiplexed communication, of the type which has been known in the art, will be used between the car and cab controllers. In such case, the serial communication between the cab controllers 33, 34, and the car controllers 15, 16 may be provided via the communication register unit function of the TMS-9900 microprocessor integrated circuit chip family, or equivalent. However, multiplexing to provide serial communications between the cab controller and the car controller could be provided in accordance with other teachings, known to the prior art, if desired.

Figure 2:
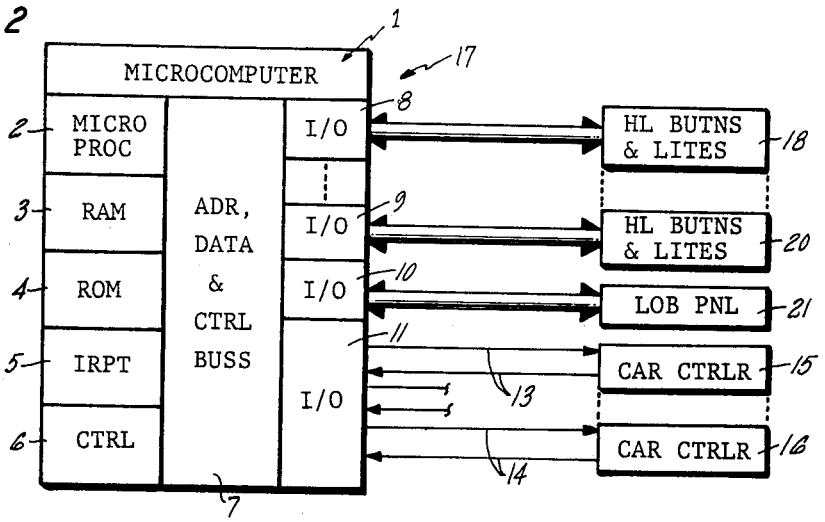
FIG. 2 is a simplified, schematic block diagram of a car controller, which may be employed in the system of FIG. 1, and in which the invention may be implemented.

Referring now to FIG. 2, a group controller 17 is illustrated simply, in a very general block form. The group controller is based on a microcomputer 1 which may take any one of a number of well-known forms. For instance, it may be built up of selected integrated circuit chips offered by a variety of manufacturers in related series of integrated circuit chips, such as the Texas Instruments 9900 Family. Such a microcomputer 1 may typically include a microprocessor (a central control and arithmetic and logic unit), such as a TMS 9900 with a TIM 9904 clock, random access memory 3, read only memory 4, an interrupt priority and/or decode circuit 5, and control circuits, such as address/operation decodes and the like. The microcomputer 1 is generally formed by assemblage of chips 2–6 on a board, with suitable plated or other wiring so as to provide adquate address, data, and control busses 7, which interconnect the chips 2–6 with a plurality of input/output (I/O) modules of a suitable variety 8–11. The nature of the I/O modules 8–11 depends on the functions which they are to control. It also depends, in each case, on the types of interfacing circuitry which may be utilized outboard therefrom, in controlling or monitoring the elevator apparatus to which the I/O is connected. For instance, the I/Os 8–10 being connected to hall call buttons and lamps and to switches and indicators may simply comprise buffered input and buffered output, multiplexer and demultiplexer, and voltage and/or power conversion and/or isolation so as to be able to sense hall or lobby panel button or switch closure and to drive lamps with a suitable power, whether the power is supplied to the I/O or externally.

An I/O module 11 provides serial communication over current loop lines 13, 14 (FIG. 2) with the car controllers 15, 16 (FIGS. 1 and 2). These communications include commands from the group controller to the cars such as higher and lower demand, stop commands, cancelling hall calls, preventing lobby dispatch, and other commands relating to optional features, such as express priority and the like. The group controller initiates communication with each of the car controllers in succession, and each communication operation includes receiving response from the car controllers, such as in the well known "handshake" fashion, including car status and operation information such as is the car in the group, is it advancing up or down, its load status, its position, whether it is under a go command or is running, whether its door is fullyopened or closed, and other conditions. As described hereinbefore, the meanings of the signals which are not otherwise explained hereinafter, the functions of the signals which are not fully explained hereinafter, and the manner of transferring and utilizing the signals, which are not fully described hereinafter, are all within the skill of the elevator and signal processing arts, in the light of the teachings herein. Therefore, detailed description of any specific apparatus or mode of operation thereof to accomplish these ends in unnecessary and not included herein.

Figure 3:
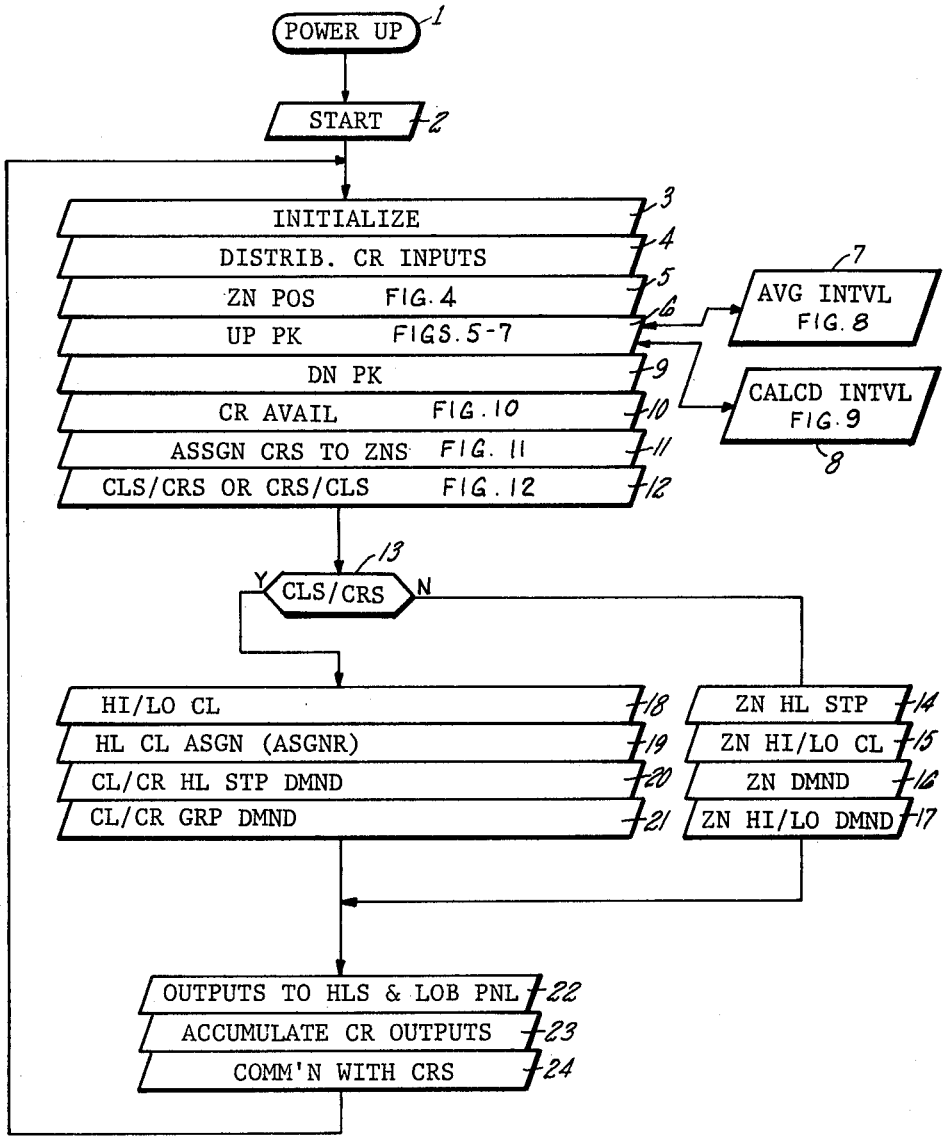
FIG. 3 is a simplified logic flow diagram of an overall group controller program which may incorporate and utilize the present invention.

Overall program structure of a group controller, based upon a data processing system, in which the present invention may be practiced, is illustrated in FIG. 3 and is reached through a program entry point 1 as a consequence of power up causing the highest priority interrupt, in a usual fashion. Then a start routine 2 is run in which all RAM memory is cleared, all group outputs are set to zero, and building parameters (which tailor the particular system to the building, and may include such things as floor rise and the like) are read and formatted as necessary, utilizing ordinary techniques. Then the program will advance into the repetitive portion thereof, which, in accordance with the embodiment described herein, may be run on the order of every 200 milliseconds. This portion of the program commences with an initialize routine 3 in which all forcing (FORC) and all inhibit or cancel (INH) functions are cleared from memory; field adjustable variables are read and formatted as necessary; the status of each car is read and formatted as necessary; and all the hall calls are scanned, and corresponding button lights for sensed hall calls are lit. Then, all inputs obtained by communication with the cars are distributed to the various maps and other stored parameter locations relating thereto in a routine 4. Then, a zone position routine 5 (described more fully hereinafter with respect to FIG. 4) is performed to identify the cars in each zone and to identify the zone in which each car is. Then, an up peak routine 6, including an average interval subroutine 7 and a calculated interval subroutine 8, which are described more fully hereinafter with respect to FIGS. 5–9, is performed to determine if there is up peak traffic, and if so to perform the various functions required, depending upon the level of traffic involved. Then, a down peak subroutine 9 may be performed to see if two cars in succession have reached the lobby with at least a half of load, and if so, to establish down peak zone operation by setting the down peak cars map to all ones (in a manner which becomes apparent as described with respect to the up peak routine hereinafter), forcing cars that are in the lobby away from the lobby, and forcing a zone group higher demand to ensure that cars will distribute themselves upwardly to the top of the building in order to bring more passengers down. Since this forms no part of the present invention, but is simply part of the overall environment in which the invention may be practiced, further description thereof is not given herein.

In FIG. 3, a car availability routine 10 updates the status of cars that are available to satisfy demand in the group, that are available for assignment to zones, and that are available to occupy zones, as is described more fully hereinafter with respect to FIG. 8, in preparation of performing the assigning cars to zones routine 11, which is described more fully hereinafter with respect to FIG. 9. Then the mode of operation, whether calls should be assigned to cars or cars should be assigned to calls, is established in a calls-to-cars or cars-to-calls subroutine 12, which is described more fully hereinafter with respect to FIG. 10. If calls are to be assigned to cars as determined in a test 13, then the program continues with a plurality of routines which assign cars to calls and create response of the cars to the assignments, utilizing relative system response as the criteria. On the other hand, if cars are to be assigned to calls, test 13 will be negative and a plurality of routines are performed, which assign cars to calls, in a type of elevator group control in which the building and therefore the calls therein are divided into a plurality of zones, as is known to the art.

The assignment of cars to calls as a consequence of cars being assigned to zones, and zone response to calls being indicated (such as during up peak or down peak traffic) is accomplished by creating demand for unoccupied zones so that cars can be assigned to them (except when cars are all forced into the assigned condition during clock up peak), determining the highest and lowest calls in the zone, generating group higher and lower demand signals for the cars to reach the calls in their zones, or to reach an unoccupied zone if a car is unassigned, or to respond to forced calls, such as lobby calls during up peak traffic.

Since these functions are generally known, and form no part of the present invention, detail logic flowcharts for achieving them are not shown herein, but the nature thereof will be described.

Specifically, in FIG. 3, a zone hall stop routine 14 updates a current map of cars requiring up hall stops or down hall stops at their committable positions, and resets hall calls (and corresponding button lights) of those indicated by the cars to have been answered. A zone high and low call routine 15 determines, for each zone of the building, the floor at which the highest and lowest hall calls are currently extant and require service. A zone demand routine 16 determines all the cars below the highest empty zone and creates higher demand to try and drive any of them that are available upward to fill the zone, and similarly determines all the cars above the lowest empty zone and creates zone demand to attempt to drive any available cars downward into the lowest empty zone. And a zone high/low demand routine 17 creates higher and lower zone demand within the respective zones to reach the highest and lowest hall calls, and then creates maps of higher and lower demand for cars in the zones to answer the calls, for unassigned cars to answer zone demands to fill empty zones, and to respond to forcing of demands or forcing of lobby calls. These routines are not new, and need not be described further, particularly in the light of similar routines described herein. They provide, however, a more complete description of the environment of the invention.

In FIG. 3, if test 13 is affirmative, then calls are assigned to cars by first performing a high/low call routine 18 which finds the highest and lowest car calls, up hall calls, and/or down hall calls in the entire building, as described more fully with respect to FIG. 11 the invention described and claimed in a commonly owned copending U.S. patent application filed on the even date herewith by Bittar, Ser. No. 099,790. Then, a hall call assignment routine 19 (FIGS. 12–18) assigns all up hall calls and all down hall calls to cars, in dependence on a plurality of variables, employing the relative system response factors of said Bittar invention. In the routine 19, each call is assigned to a specific car for response; but in accordance with an invention described and claimed in a commonly owned copending U.S. patent application filed on even date herewith by Bittar, Ser. No. 099,945, the calls are updated every time the routine of FIG. 3 is performed, thereby allowing improved assignments in accordance with changes in conditions. Since the routine of FIG. 3 is performed, in the embodiment herein, every 200 milliseconds or the like, this means that conditions that change in much less time than it takes a high-speed run past a floor without a stop, can be included in improving the assignment of calls to specific cars. The results of the calls to cars assignment which take place in the routine 19 are utilized in a call/car hall stop demand routine 20, and the running of all cars to which calls are assigned is controlled by a call/car group demand routine 21, which is described more fully in said Bittar applications.

In FIG. 3, regardless of whether calls are assigned to cars or cars are assigned to calls, the results of all of the routines on FIG. 3 are outputted appropriately once in each cycle. For instance, an outputs to halls and lobby panel routine 22 may provide direct discrete outputs, operate lights and the like, as is deemed appropriate in the various hallways and at the lobby panel. An accumulate car outputs routine 23 sorts out the information relating to respective cars into car format, in preparation of performing a communication with the cars routine 24, which may utilize the serial (communication register unit) method of providing each car with updated information, or may provide it over parallel data buses, if desired. And then, the routine repeats by again commencing through the initialize routine 3, as described hereinbefore.

Figure 4:
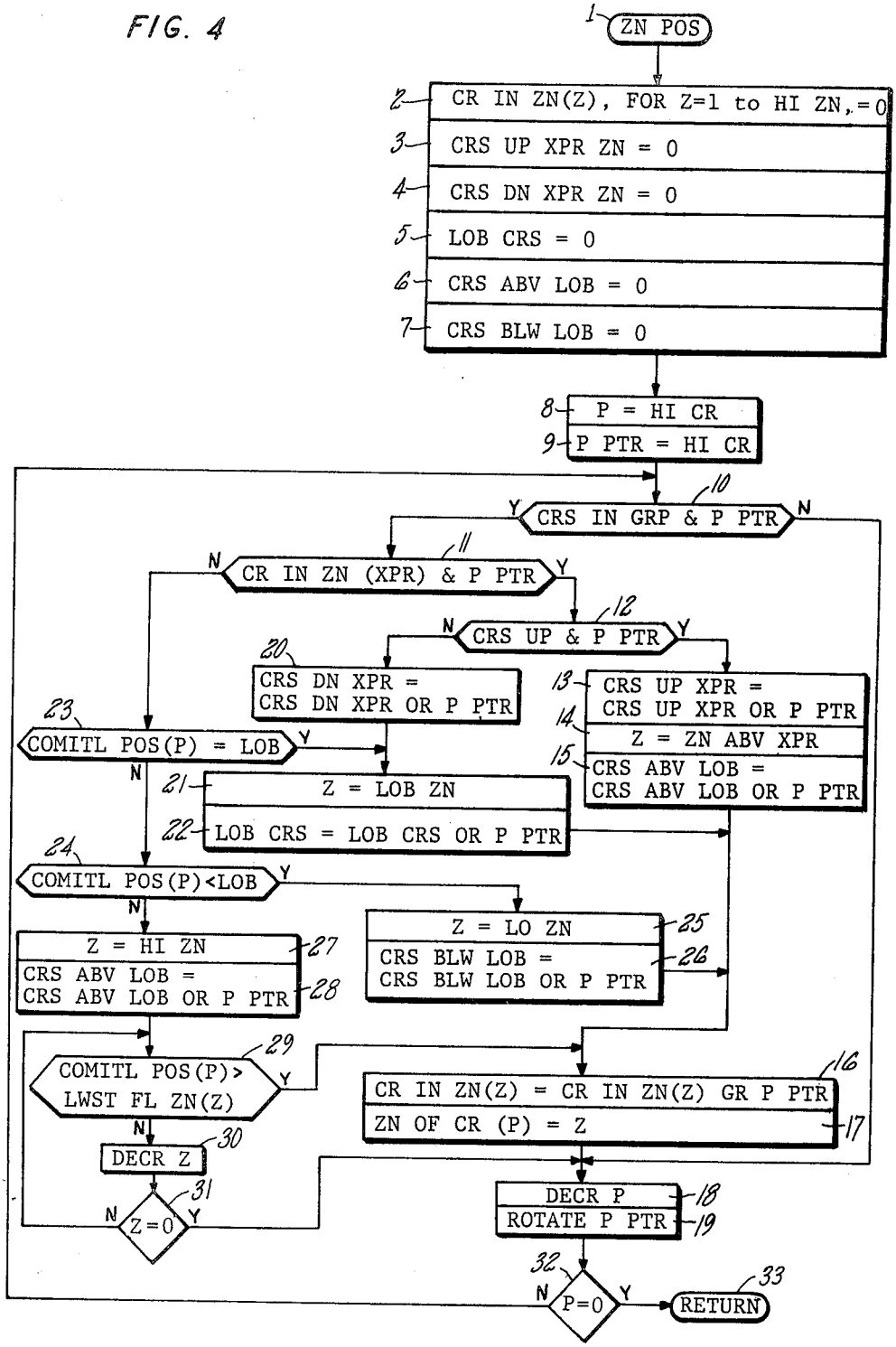
FIG. 4 is a logic flow diagram of a zone position routine.

The zone position routine is illustrated in FIG. 4 is reached through an entry point 1 and commences by resetting to all zeros, maps of cars in zones, for each zone from one to the highest zone in step 2, cars traveling up in the express zone in step 3, cars traveling down in the express zone in step 4, lobby cars in step 5, cars above the lobby in step 6, and cars below the lobby in step 7. Then a P number and a P pointer are set to the highest car in the group in steps 8 and 9. Test 10 interrogates whether the car indicated by the P pointer is in the group; if not, the functions of this routine are bypassed with respect to that car. But if so, test 10 is affirmative and a test 11 determines whether this car indicates that it is runnning through an express zone. If it was, then the map of cars which are traveling up as compared with the P pointer in a test 12 and an affirmative result indicates that the car is traveling up in the express zone and updates a map thereof in step 13. Then a zone number is set to be equal to the zone above the express run in a step 14 and the cars above lobby map is updated by ORing the P pointer into it in step 15. Then, in a step 16 a map of cars for the zone Z set in step 14 is updated by ORing the P pointer into it, which is permissible because it is initially reset in step 2, hereinbefore. Then a number indicative of the zone in which the car P is situated in set equal to the zone Z (identified in step 14 above) in step 17.

In FIG. 4, steps 18 and 19 cause the next lower car to be identified so that test 10 can be repeated for a second car in the group. Assuming that the car is in the group and is in an express zone as before, test 12 will determine whether the car is running up or not. If it is not running up, then it is running down so that a step 20 will update a map of cars running down in the express zone by ORing the P pointer into it. In such a case, the next zone to be encountered is the lobby zone so that Z is set equal to the lobby zone in step 21 and a map of cars at the lobby is updated by ORing with the P pointer in step 22. The map of cars in the lobby zone is then updated in step 16 and the zone of car P is set to the lobby zone number in step 17 as before. Steps 18 and 19 thereupon are decremented to relate to a third car in the group. Assuming for descriptive purposes that step 10 is affirmative but the third car being considered is not in the express zone, test 11 will be negative. This will cause a test 23 to determine if the committable position of the car (which is provided to the group controller by the car controller) is the lobby. If it is, the action is the same as for a car running down in the express zone as described hereinbefore. But if not, then a test 24 determines if the committable position is lower than the lobby. If it is, Z is set equal to the low zone (which is assumed to be a zone below lobby in the general case) in a step 25 and the map of cars which are below the lobby is updated by ORing with the P pointer in step 26. Then the zone and car status are again updated in steps 16 and 17 and the next car is reached by steps 18 and 19.

In FIG. 4, assume that the fourth car interrogated results in an affirmative response to test 10 and negative responses to tests 11, 23, and 24. In such a case, the particular zone involved (which by this time is known not to be the lobby or the low zone and not to relate to the car having previously been in an express zone). A step 27 sets a zone number equal to the highest zone in the building. And a step 28 updates the map of cars above the lobby by ORing the P pointer into it. Then, a test 29 determines if the committable position of the car under consideration is greater than the lowest floor in the zone Z (which is provided by a map of floors in each of the zones, and the selected zone Z has its map compared with the committable position of the car P in step 29. If it is, this indicates that the car is in the zone and that fact is registered for the car and the zone in steps 16 and 17 as described hereinbefore. Then steps 18 and 19 pick yet another car, and assuming that step 27 has previously been reached, it will be reached again. And if even the fifth car is still in the zone, step 29 will again be affirmative so that both this car and the last car may be identified as being in that zone. But if step 29 is negative, the zone is decremented in a step 30 and if it has not reached zero (below the lowest zone) as indicated in a step 31 then this car, P, will be tested against the next lower zone to see if its committable position is higher than the lowest floor in the next lower zone. Ultimately, all of the cars will be identified as being in one of the special zones (lobby, low zone, or zone above express, or the express zone itself, or any other zone at the high end of the building). Notice that express zones do not have cars assigned to them, but are simply identified as being there, since no service is to be provided in an express zone.

In performing the routine of FIG. 4, more than one car may be assigned to the same zone and the passage through the routine is dependent simply upon the conditions relating to a given car with respect to the zones of the building, as described hereinbefore. The manner in which a car is determined to be in the express zone, for interrogation in step 11, is through the test 29, described hereinbefore. Thus, step 29 will initially identify the car as being within an express zone in one pass through the program of FIG. 4, and its status as being heading for the lobby zone or the first zone above the express zone will take place in subsequent passes through the program of FIG. M2. When all of the cars have been tested, a test 32 will determine that P=0, and the program will return to the main program by means of a transfer point 33.

In the embodiment herein, after the zone position subroutine of FIG. 4, the main program will call other programs, some of which are described hereinafter.

Figure 5:
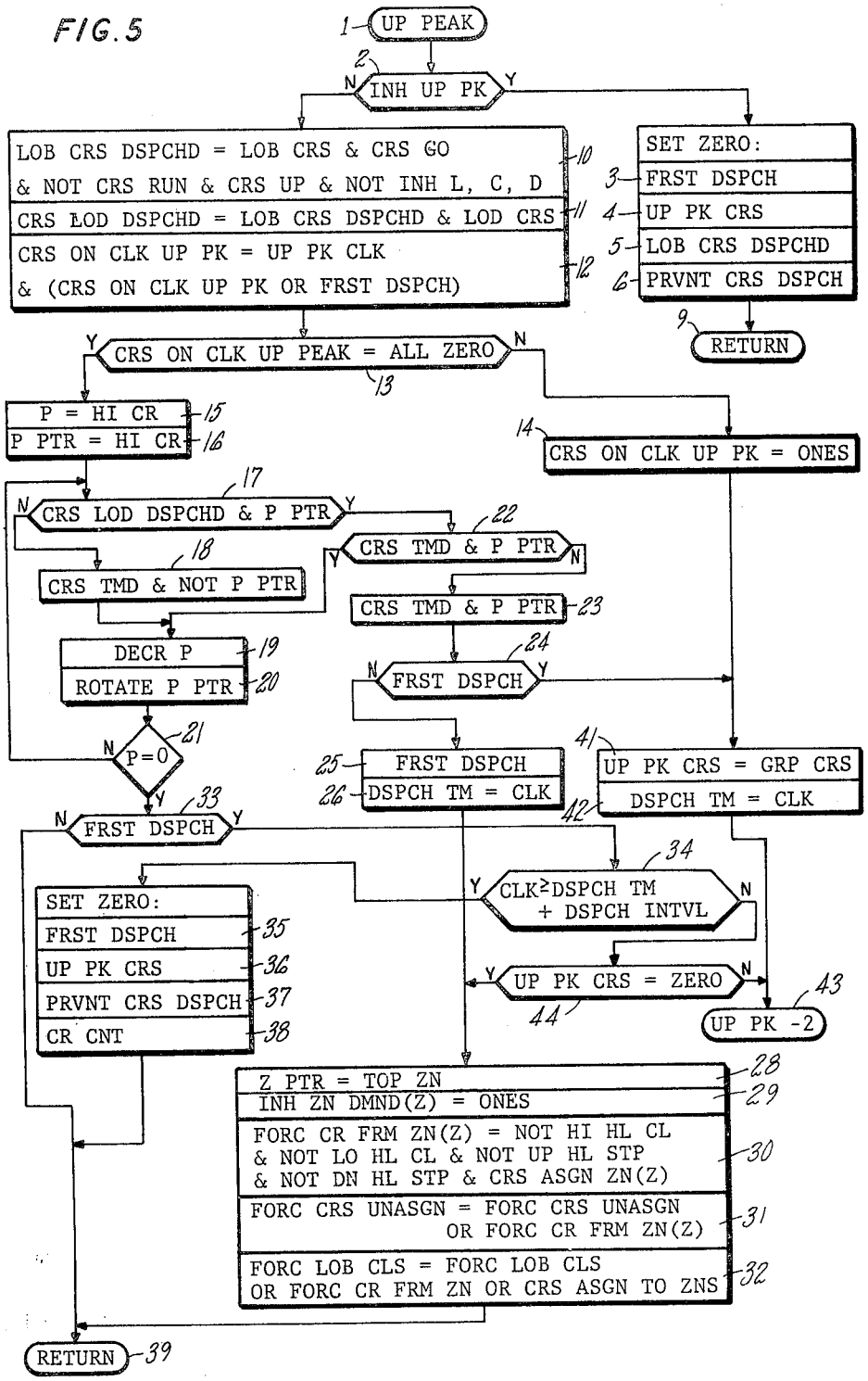
FIGS. 5–7 are logic flow diagrams of an up peak routine.

The up peak routine is entered through an entry point 1 on FIG. 5 and a test 2 determines if up peak is inhibited for some reason (such as fire service or the like). If it is, then steps 3–6 reset the first dispatch flag and sets the following pointers to all zeros: up peak cars, lobby cars dispatched, prevent cars dispatch, and others, depending on the implementation. And the main program is returned to through a return point 9. In the usual case, however, test 2 of FIG. P1 will be negative so determination of whether or not incoming traffic merits up peak handling by the group controller is to be made. In a step 10, a lobby cars dispatched map is determined as the AND of maps indicating lobby cars, cars with go signals, cars not running, and cars set with their advance direction up, provided lobby cars dispatch is not inhibited. In a step 11, a cars loaded-and-dispatched map is determined as the logical AND of the lobby cars dispatched map and the loaded cars map (each car determining that it is more than half full by weight). And step 12 updates the map of cars on clock up peak by ORing the first dispatch flag into one bit of that map, and ANDing the same bit with the up peak clock flag. The up peak clock flag may either be a key switch with which lobby personnel determine when timed up peak is to occur, or could be a simple 24 hour timer, that would provide a discrete signal at a certain period of the day, such as between 8:30 and 9:30 am. If the up peak clock is on, clock up peak is still not entered into unless at least the car leaves the lobby with a load (at least half full). This avoids going into up peak on weekends and holidays simply because of the time of day, when a timer is used. The difference between clock up peak and load dispatched up peak is controllable, from one installation to the next, but clock up peak will normally be retained throughout the clock period, once it is entered, even though there are periods of low traffic at the lobby, because the morning rush tends to come in bunches, such as from buses and subways that deposit a lot of people near the building at one time, and this must be anticipated by continuing to bring all of the cars back to the lobby to handle the heavy up flow of traffic. On the other hand, load dispatched up peak continues only so long as the heavy traffic continues, as determined by successive cars, leaving at least half full within a dispatch interval, but ending when the interval exceeds a certain time. This type of peak is more likely to occur such as at the end of the noon hour when the incoming traffic is rather sporadic and will not necessarily continue for a determinable period of time. There are other differences in the embodiment herein, as become apparent hereinafter.

In FIG. 5, a test 13 determines whether step 12 has inserted any bit at all in the cars on clock up peak map. If it has, then this map will not be all zeros, so that it is converted in a step 14 to all ones, assigning all the cars to clock up peak status.

But if test 13 in FIG. 5 is affirmative, the up peak clock is not on, so the determination of whether loaded cars are leaving within small dispatch intervals is made. To do this, it is necessary to consider each car, one at a time, distinguishing one car from the next, and determining when successive distinct cars have left the lobby with a load. The timing is compared against a dispatch interval, a load up peak is declared. Steps 15 and 16 set a P number and a P pointer to the highest numbered car in the building. Then the map of cars loaded and dispatched (step 11) is compared with the P pointer to see if the car under consideration is about to leave the lobby with a load. If not, this particular car is not involved, but because it may previously have been, a map of cars which have been considred in dispatch timing has the car under consideration removed from it, in a step 18. And the P number and P pointer are lowered to the next-numbered car in steps 19 and 20, P is tested for zero to determine if the last car has been considered in test 21. If the last car has not been considered, the routine returns to test 17. If the next car under consideration is loaded and about to be dispatched from the lobby, test 17 will be affirmative. If this car has not previously been so determined, a test 22 will be negative so that the map of cars timed for dispatch considerations will be updated in step 23 to add this car to the map. Then a first dispatch flag is interrogated in test 24 to see if a previous dispatch has occurred for which there if currently running a time interval. If not, test 24 is negative and the first dispatch flag is set in step 25 and the dispatch time for this car is set to equal the time of a real time clock in step 26. Then, because one car has left fully loaded, a first, low level of up peak operation is entered into in steps 28–32 by excluding demands in the highest zone, forcing the cars out of the highest zone, forcing these cars to be unassigned, and creating lobby calls (such as by forcing car calls within the cars) in the cars forced from the highest zone of the building. In step 28, a zone pointer is set to the top zone. Then all cars are inhibited from having zone demand in the top zone by setting the corresponding map to ones in step 29. A map of cars to be forced from the top zone is then established by ANDing the maps of cars without high hall calls, cars without low car calls, cars without up hall stops, cars without down hall stops (representing activity that must be completed by the cars) and cars assigned to the top zone (so that this only affects those in the excluded, top zone) all in step 30. And step 31 forces such cars to unassigned status while step 32 updates the map of forcing lobby calls by ORing that map with the maps of cars forced from the top zone and of cars assigned to the top zones. This provides all cars with lobby calls but lets most cars respond to other calls in their assigned zones, during this limited form of up peak operation. Then this routine is ended and returns to the main program by a return point 39.

In the next pass through the up peak routine of FIG. 5, assume test 2 is negative, test 13 is negative so that steps 15 and 16 again establish the high car to be examimed first, and step 17 will be negative for all cars which are not about to leave the lobby with a load. If the car which has previously been ready for dispatch with a load as described above is still at the lobby, test 17 will be affirmative; this may occur if the up peak routine is run on a 200 millisecond basis, or so, since several seconds are required following a go signal in order to close the doors of the car, and if a door reversal is caused by a late passenger hitting the safety switch, even more time may be involved. So if this car is still awaiting dispatch with a load at the lobby, test 17 will be affirmative but test 22 will also be affirmative this time so that the dispatch time is not altered in step 26. This is an indication of the need to keep track of each individual car in establishing whether or not two cars have left the lobby loaded within a given interval. But if a second car has become loaded and ready for dispatch, test 17 will be affirmative for that car but test 22 will be negative for that car. Such a car will be added to the map of cars which have been timed in step 23 but test 24 will be affirmative so that a full fledged up peak is indicated (almost in the same fashion as a clock up peak which is indicated by a negative result of step 13 described hereinbefore). This is described more fully hereinafter.

But if test 17 in FIG. 5 is negative for all other cars during this pass through the routine, the map of cars timed is reenforced to not include any such cars in step 18, and all cars are considered by proceeding through the P number and P pointer in steps 19 and 20 and determining when all cars have been considered in step 21. Whenever step 17 is negative or step 22 is affirmative for all of the cars, test 33 is reached to determine if only one car has been dispatched with a load. This is the normal case when a single car happens to have a load and leave the lobby, but within several passes through the routine of FIG. 5, no other cars leave the lobby with at least a half load. In such case, test 33 is affirmative so that a test 34 is made to see if the clock time exceeds the time of dispatch of the first car plus some predetermined dispatching interval within which two cars must leave the lobby in order to declare an up peak condition. If the time has passed, that means the interval has been exceeded, and having only dispatched one loaded car, an up peak is not indicated. In such a case, the first dispatch flag is reset in a step 35, the map of up peak cars is set to all zeros, because this is an indication of the end of an up peak. Even clock up peaks end after expiration of the clock, bypassing through this portion of the routine, due to test 13. The map of preventing cars from being dispatched is set to all zeros in step 37 so that car dispatching at the lobby can be based on ordinary car considerations, rather than group up peak control, and a car count (used in the up peak routine of FIG. 8, as described hereinafter) is reset to zero in step 38. This is the manner in which a nonclock up peak is ended, and the routine is exited (since the up peak functions about to be described hereinafter) need not be performed and the program returns to the main program through a transfer point 39.

In the case where no cars are leaving the lobby half full, test 13 will be affirmative, 17 will be negative, and 33 will be negative in every pass through the routine of FIG. 5, so that no up peak considerations need be made at all, and the up peak program returns to the main program through the transfer point 39.

In the case where one car has left the lobby loaded, and in subsequent passes through the routine of FIG. 5, no other cars are determined to have left the lobby loaded, step 33 will be reached as described hereinbefore; but if the timer has not timed out as indicated by a negative result of test 34, then a test 40 is made to determine whether up peak has previously been ordered by determining whether the map of up peak cars has any ones in it or not. If not, the test 44 will be affirmative and the single zone exclusion, called into play by a single car leaving the lobby with half a load, is continued as described with respect to steps 38–31 hereinbefore. But if up peak has been established for any car, test 44 will be negative, and the up peak will continue. This test comes into play at the end of a previously established load-created up peak operation (in contrast with a clock up peak) so as to continue the second level up peak operation, excluding more than the top zone, until such time as no second car has left within the up peak interval as determined by step 34, when the load-created up peak will end.

As described hereinbefore with respect to the routine of FIG. 5, if test 13 is negative or if test 24 is affirmative, up peak group operation is commanded by entering a step 41 which sets the map of up peak cars equal to a map of all the cars in the group. The dispatch time is updated in a step 41 in each pass through the routine of FIG. 5 during a bonafide up peak operation to permit determination of when the operation should end (when two successive cars have not left the lobby half loaded within the interval, or when following the time out of the clock, successive cars have not left the lobby half loaded within the dispatch interval). The testing of the timer when set in step 42 wll be in step 34 as described hereinbefore under conditions where the group is not on clock up peak, and only one car has as yet been determined to have left since the last setting of the dispatch time by the clock in step 42. Whenever the clock is off, and the traffic slows down so that test 34 is reached and is affirmative, the up peak will end as described with respect to steps 35–38 hereinbefore.

Figure 6:
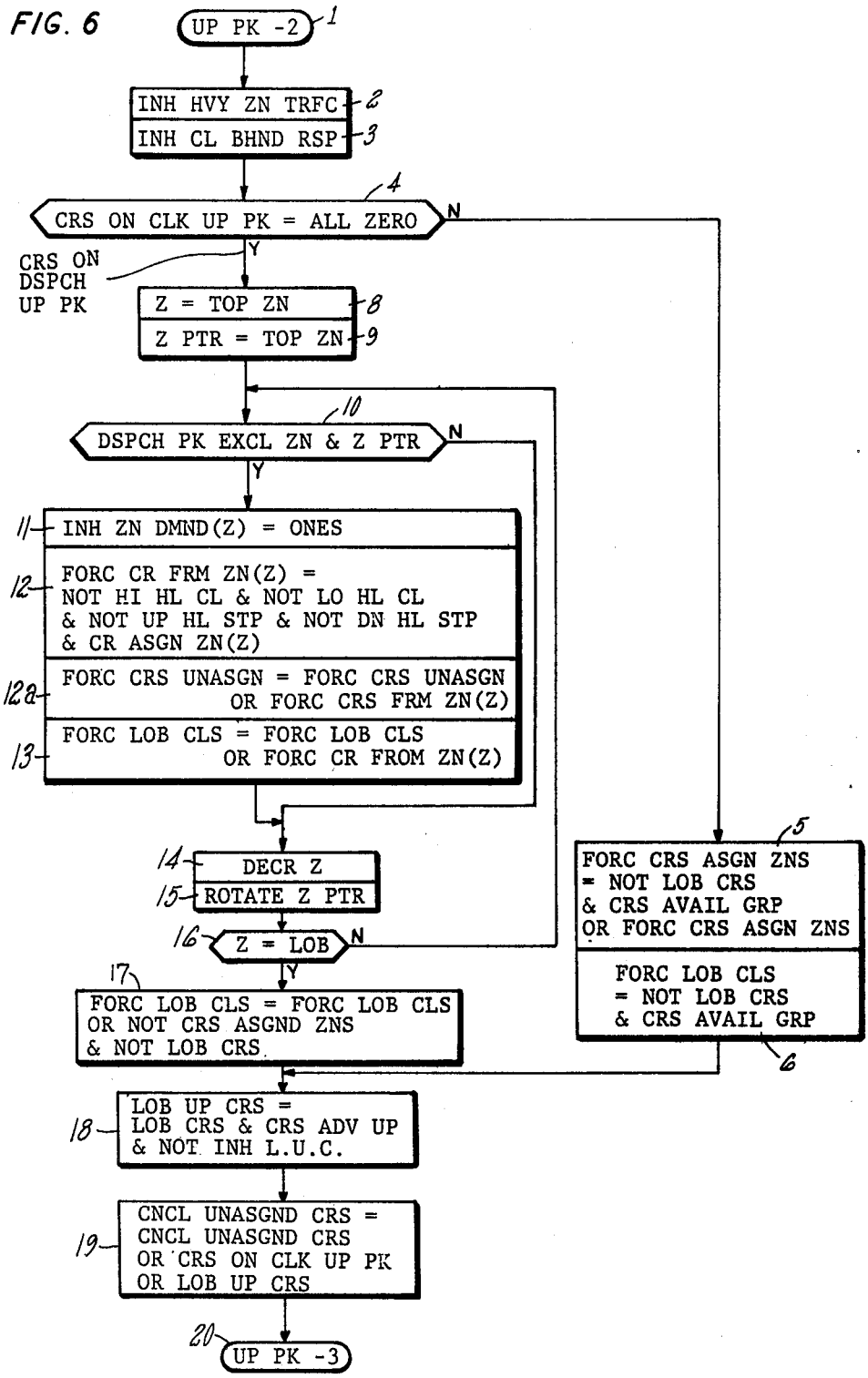

In the routine of FIG. 5, the difference between continuing an up peak and determining if up peak can end is expressed by reaching a transfer point 43 (that continues the up peak operation by) means of test 44 when the up peak may be ending, rather than by tests 13 or 24 when the up peak is known to be continuable through at least another cycle. In any event, the routine of FIG. 5 will pass through the transfer point 43 to the continuation of the peak routine in FIG. 6 by means of transfer point 1 thereon. In FIG. 6, steps 2 and 3 inhibit the zone functions called heavy zone traffic and call behind response, if such are included in the zone operation characteristics of a given installation. These have to do with whether or not calls to subfloors below the lobby are to be allowed, and change of car advance direction to answer calls in a zone where the car is assigned. They have nothing to do with the present invention and are not described herein.

In the routine of FIG. 6, a test 4 determines whether the group is on a clock-generated up peak, or on an up peak generated simply by two cars leaving the lobby half loaded within a dispatch interval. The difference is the number of zones which may be excluded from normal operation and thereby release cars to be forced to the lobby to continuously serve the lobby during the up peak. When a clock up peak is involved, a larger number of zones is normally excluded, typically all of the zones in the group, to make all of the cars available to serve the up peak traffic. But when load determined up peak is involved, since it is not known how long the up peak will last, and it may be of short duration, a fewer number of zones (such as three or four) may be forced to release their cars to serve the lobby. Specifically, if test 4 is negative, indicating that the map of cars on clock up peak has some ones in it, a step 5 forces a map of cars assigned to zones to be updated by Oring it with itself and with the logical AND of a map of cars available to the group and a map of cars which are not presently at the lobby floor. Then a step 6 updates a map of cars in which lobby calls should be forced by loading it with the logical AND of a map of cars and the map of cars which are available to the group set in step 5.

In FIG. 6, if test 4 determines that the up peak is not an up peak clock controlled up peak, but rather one caused by dispatching of two loaded cars within the dispatch interval, then the functions of providing cars to service the dispatch is done to less than all of the zones. Steps 8 and 9 set a zone number and a zone pointer to the top zone in the building. Then, a test 10 determines if the indicated zone is one of the zones which have been established as zones to be excluded thereby freeing cars for up peak service during a dispatch-created up peak. If it is such a zone (and normally the top two zones will usually be so allocated, although additional upper zones may also be allocated, then the test 10 is affirmative and step 11–13 inhibit all zone demand against cars in the zone, force the cars from the zone and force lobby calls, as is described hereinbefore with respect to steps 29–31 of FIG. 5. Then steps 14 and 15 (FIG. 6) advance to the next lower zone, and until a test 16 determines that all of the zones have been considered down to but not including the lobby zone, the process is repeated. But when test 16 indicates that the zone to be considered is the lobby zone, the consideration is ended and a step 17 updates the map of cars in which calls to the lobby are to be forced by Oring itself with the logical AND of a map of cars not assigned to zones and cars not presently at the lobby floor. This prevents forcing lobby calls in cars which are satisfying demand in any of the zones which are not excluded to serve the up peak, in addition to those cars forced to the lobby from the excluded zones as in step 13 hereinbefore.

In FIG. 6, steps 5 and 6, in contrast with steps and test 8–17, are one of the distinctions between a full fledged clock up peak, and a dispatch-created up peak.

In FIG. 6, any up peak continues with a step 18 which creates a map of lobby cars which are directed in the up direction as the logical AND of lobby cars, cars in which the commanded direction is up, and cars not inhibited from the map of lobby up cars. Then a step 19 creates a map of cars in which the unassigned condition is to be cancelled as the logical OR of itself, or of a map of cars on clock up peak, or of a map of cars at the lobby in the up direction (step 18). Then the up peak routine is continued by transferring from FIG. 6 at a transfer point 20 to a transfer point 1 in FIG. 7.

Figure 7:
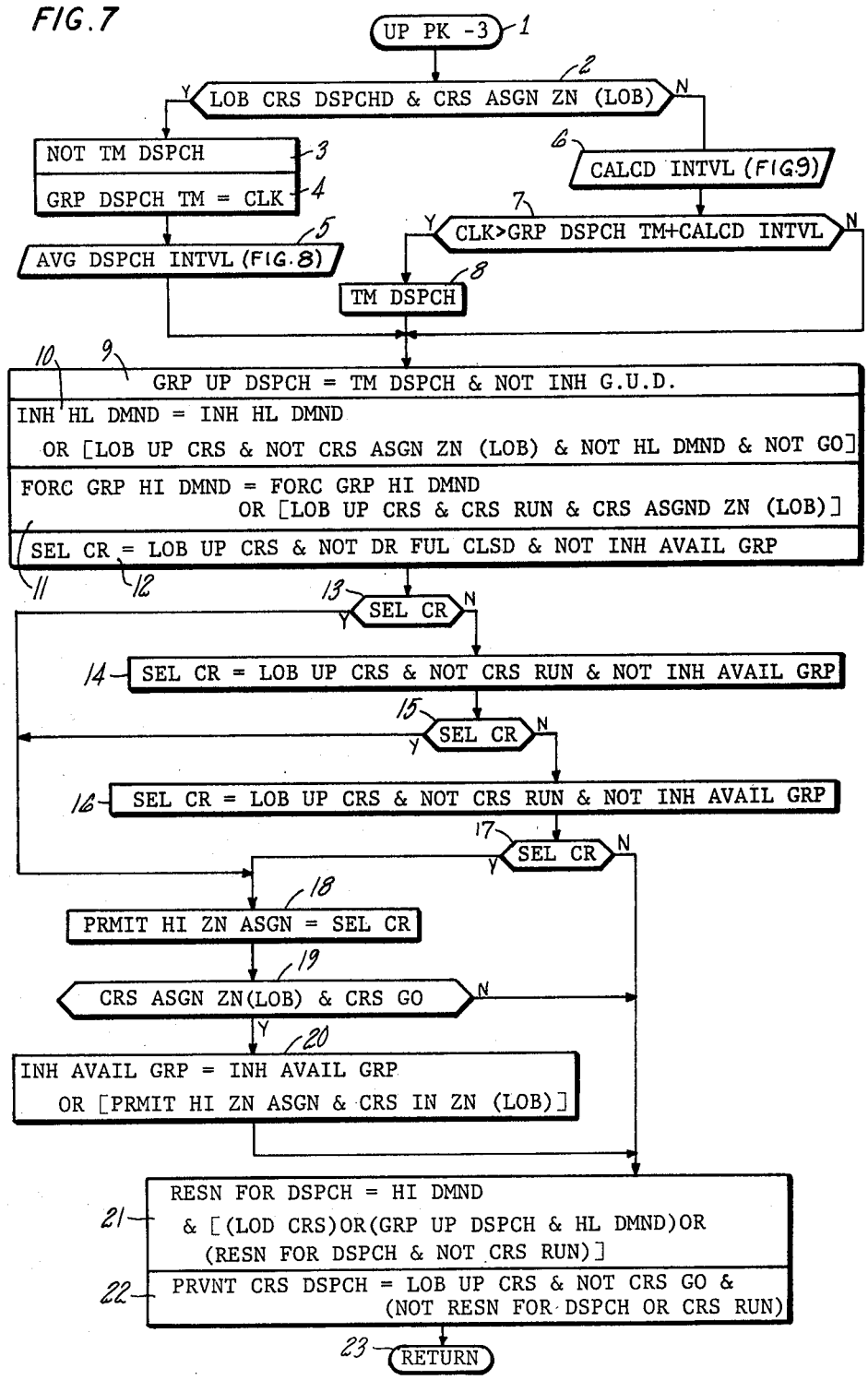

In FIG. 7, a test 2 determines by ANDing of two maps whether there are any cars that are lobby cars being dispatched (step 10, FIG. 5) which are cars assigned to the lobby zone. If there are, dispatch is prevented by resetting a time for dispatch flag in a step 3 and the group dispatch time is set equal to the real time indicated by a clock in a step 4. Then, an average dispatch interval prediction is calculated in an average dispatch interval subroutine 5, described hereinafter with respect to FIG. 8. This provides an indication, as each car is dispatched, of the anticipated time it will take for the car to return to the lobby, in dependence upon the particular car calls registered in the car. It then averages this for the last three cars to have been dispatched, to get an indication of the average dispatching interval for the current traffic load at the lobby. It also then compares this against the number of available cars in service to determine the expected interval between dispatching cars for the current load of lobby traffic.

In subsequent passes through the routine of FIG. 7, the test 2 must be negative since between performing the functions on FIG. 7 in two successive passes (200 milliseconds or so apart), the cars assigned to zones routine will have removed the particular car in question from the lobby zone since it has been dispatched with a go signal. It is therefore not any longer assigned to the zone. Therefore, test 2 will be negative and a calculated interval subroutine 6 will be performed as is described with respect to FIG. 9 hereinafter. This routine utilizes the expected average dispatching interval and other factors, such as the number of cars at the lobby and whether a clock up peak or a dispatch-created up peak are involved, to provide a dispatching interval which will determine the time between dispatching of successive cars. The average dispatch interval provided by the subroutine 5 is only utilized to provide the modified, calculated interval of the subroutine 6, all as is described hereinafter.

In FIG. 7, a test 7 determines whether the dispatching interval has expired by comparing the current time of the clock with the time when the last car was dispatched plus the calculated interval. If the time has not yet elapsed, dispatching of cars is still inhibited; but if the time has elapsed, test 7 will be affirmative and will set the time for dispatch flag in a step 8. And, in each pass through the routine of FIG. 7, a group up dispatch flag is generated if step 8 has indicated time for dispatch and the group up dispatch is not inhibited, in a step 9. Then, the inhibit hall demand map (which controls group demands and lanterns at various floors for all of the respective cars) is updated by Oring with itself the logical AND of maps indicating lobby up cars, cars not assigned to the lobby zone, but excluding cars which already have a hall demand or have a go signal. Among other things, this prevents hall lanterns at the various cars in the lobby until they get a go signal, but continues those hall lanterns until the cars lose the lobby assignment at the commencement of their up runs. A step 11 creates a map of cars in which group higher demand is forced by Oring that map with the logical AND of maps of lobby up cars, cars in the run condition, and cars assigned to the lobby zone. This will force an up lantern on any car running up to the lobby and assigned to the lobby zone.

In FIG. 7, the next function is to select the most peferably car to be dispatched next from among various cars at the lobby. First, a step 12 will set the selected car map to include only a car which is a lobby up car, in which the doors are not fully closed, and which is not inhibited from being available to the group. Then the map is tested to see if this combination of maps has come up with a selected car in a test 13. If not, the selected car map is set to include only lobby up cars, cars not in the run condition, and cars not inhibited from being available to the group, in a step 14. Again, this map is tested to see if there are any cars in it in a test 15, and if not the map is again created in a step 16 to include only cars which are lobby up cars, cars which are running and not inhibited from being available to the group. Thus, the first preference is for cars with the doors open, the second preference is for cars stopped at the lobby with the doors fully closed, and the last preference is for cars running into the lobby (step 16). If none of these are available, a test 17 is negative, but if any of tests 13, 15, or 17 is affirmative, a preferred lobby car is available and a permit higher zone map is set equal to the map of the selected car in a step 18. A test 19 is performed to see if the car assigned to the lobby zone map has a go signal, and therefore is being dispatched, so that another car should be assigned to the lobby for subsequent dispatch. If test 19 is affirmative, a car is selected from those within the map of preferred dispatch cars. The car so selected is then removed from being available to the group (since it will be dispatched on up peak service) by updating the map of cars inhibited from availability to the group by Oring it with itself and the logical AND of the permit higher zone map and the map of cars positioned in the lobby zone.

The routine of FIG. 7 concludes with establishing a reason for dispatch map in step 21, which is the logical AND of high demand map with any one of three other maps, one being loaded cars, another being the logical AND of group up dispatch and hall demands, and the third being the logical AND of reason for dispatch cars not running. Thus, if any car has a higher demand, it will have a reason for dispatch if it is loaded, or if there is a group up dispatch for that car and its hall demand is established (its hall light lit) or it has previously had a reason for dispatch and is not running. Then in step 22, a map of signals to prevent cars from being dispatched is generated as the logical AND of maps for lobby up cars, cars which do not have a go signal and cars which either have no reason to be dispatched or are running. This concludes the up peak routine (the average dispatch interval subroutine and calculated interval subroutine thereof being described hereinafter with respect to FIGS. 8 and 9) so the routine returns the main program through a return point 23.

Figure 8:
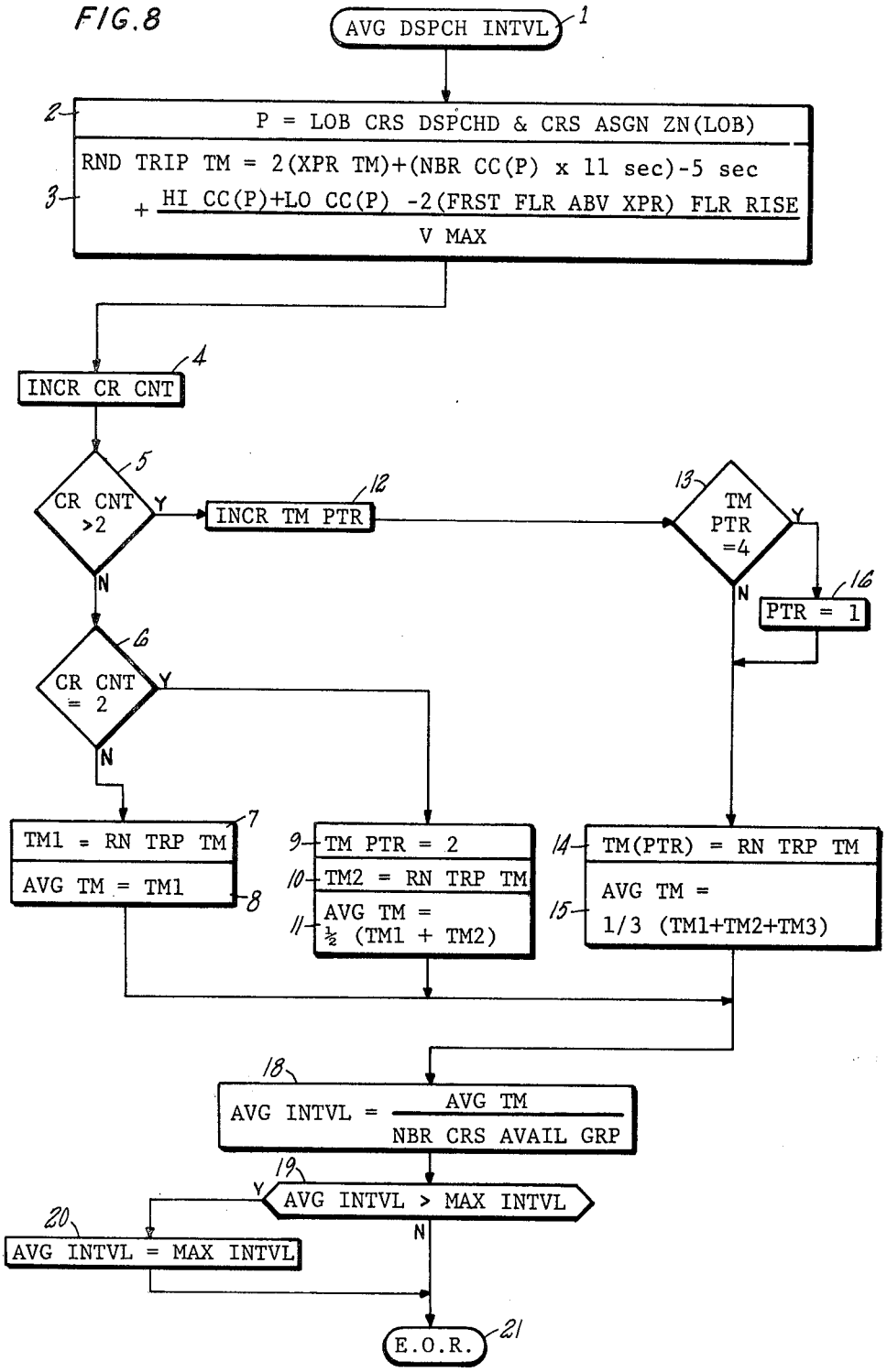
FIG. 8 is a logic flow diagram of an average interval subroutine for use in the up peak routine of FIGS. 5–7.

Within the up peak routine, however, the average dispatch interval subroutine 5 (FIG. 7) is called by means of an entry point 1 on FIG. 8. Therein, a series of steps 2 determine a round trip time in accordance with the principles set forth in the following table.

$$\text{RND TRP TM(P)} = \text{TM RN UP(P)} + \text{TM SERV CLS(P)} + \text{TM RN DN(P)}$$

$$\text{TM RN UP(P)} = \text{XPR TM} + \text{TM TO LO CL(P)}$$

$$\text{TM TO LO CL(P)} = \frac{\text{(LO CC(P)} - \text{FRST FLR ABV XPR) FLR RISE}}{\text{V MAX}}$$

$$\text{TM SERV CLS(P)} = \text{Sum of (TM BTW FLR} + \text{TM PANGR TRANS)} = \text{(NBR CC(P)} \times 11\text{ sec)} - 5\text{ sec}$$

$$\text{TM RN DN(P)} = \text{XPR TM} + \text{TM FRM HI CL(P)}$$

$$\text{TM FRM HI CL} = \frac{\text{(HI CC(P)} - \text{FRST FLR ABV XPR) FLR RISE}}{\text{V MAX}}$$

$$\text{RND TRIP TM(P)} = 2(\text{XPR TM}) + (\text{NBR CC(P)} \times 11\text{ sec}) - 5\text{ (sec)} + \frac{\text{[HI CC(P)} + \text{LO CC(P)} - 2(\text{FRST FLR ABV XPR)] FLR RISE}}{\text{V MAX}}$$

In the Table, the round trip time anticipated for the car about to be dispatched is determined as the summation of the time to run up to the first call, the time to service all of the calls registered in the car, and the time to run down from the highest call back to the lobby. The time to run up to the first call is the time to run through an express zone if there is one for this car, plus the time to reach the floor of the lowest call. The time to reach the lowest call is the floor of the lowest car call minus the first floor above the express zone times the distance of the floor rise (that is the distance between floor landings above the express zone) divided by the maximum velocity of the elevator (which the elevator will be running at since it always achieves maximum velocity in an express zone). If there is no express zone, the car may not achieve maximum velocity, but the time will be a very small portion of the total and therefore the error therein can be ignored. The time to service the calls is the summation of the time between floors and the time for passenger transfers for each of the car calls. If it is assumed that it takes 5 seconds to move the elevator from one floor to the next, and 6 seconds to service the calls while stopped at the landings, then the time to service calls will be 11 seconds for each floor, except the lowest call which is reached within the time allocated above (in the time to reach the lowest call). This therefore can be taken as the number of car calls times 11 seconds, minus the 5 seconds not needed to reach the lowest car call. The time to run down is similar to the time to run up and includes the express run time plus the time to reach the floor above the express zone from the highest car call. The time from the highest car call is the floor of the highest car call minus the first floor above the express zone times the distance of floor rise per floor in the building divided by the maximum velocity of the elevator. Putting this altogether and simplifying it, the round trip time equals the express zone running time plus the number of car calls times 11 seconds (or some other time factor) minus the 5 seconds as described above, plus the summation of the floor of the highest and lowest car calls minus twice the floor number of the first floor above the express zone, times the distance in floor rise from floor to floor over maximum velocity. This is established in step 3 for a particular car P, which is identified in step 2 by setting the P pointer equal to the number of the car being dispatched. After that, a step 4 increments a car count (which is always reset during nonpeak periods by step 38 in FIG. 5) so that the first round trip time calculation will be with respect to the first car dispatched during any particular up peak period. Then, a test 5 determines if the car count is greater than 2 (meaning that it is 3) and if not, a test 6 determines if it is equal to 2. If not, a step 7 sets a first car round trip time register (TM1) eual to the round trip time which has been calculated in step 3 and a step 8 determines that the average time is simply this single time that has so far been determined, since only one car has been dispatched during this particular declared up peak period. When the second car is dispatched during the up peak period, a new calculation of estimated round trip time will be made for it in step 3, step 4 will increment the car count, step 5 will be negative since the count is now 2, but step 6 will be affirmative. At this point, a time pointer is established with a setting of 2 for purposes described just below. The time for the second car to be dispatched during an up peak is then set as being equal to the round trip time which has just been calculated for it in step 3, in steps 9 and 10, and a step 11 provides the average time as being half the sum of Time 1 and Time 2. If an up peak survives more than two cars leaving (as it will during all clock up peaks, and many load dispatched up peaks) the next pass through the routine of FIG. P5 will cause a third round trip time to be calculated for the currently-dispatched car, the car count will be incremented in step 4, and since this will now be set to a 3, test 5 will be affirmative. The time pointer is incremented in a step 12 and is tested in a test 13 to determine if it is equal to 4. Initially, it is not so a step 14 is reached in which the round trip time for the time register referred to by the pointer (initially 3) is set to equal the round trip time calculated in step 3 hereinbefore. And the average time is (step 15 as $\frac{1}{3}$ the summation of the times set in the registers for Time 1, Time 2, and Time 3. On any subsequent pass, the fourth car to be dispatched will cause the car count to be 4, which is greater than 2, so test 5 will continue to be affirmative in all successive passes. Step 12 will continuously increment the time pointer, test 13 will continuously test it, and the first time it will advance to 4 giving an affirmative result so that a step 16 will reset the pointer to 1. Step 14 therefore causes the currently generated round trip time of step 3 to be stored into the Time 1 buffer register, leaving the previously established values for Time 2 and Time 3. And step 15 therefore will provide a new average because the Time 1 value has changed. In a similar fashion, the time for the fifth car will be set into the Time 2 register, the time for the sixth car will be set into Time 3 register and so forth so that every car dispatched during the current up peak operation will have its time averaged into the times of the last two previously dispatched cars.

In FIG. 8 a step 17 determined the average interval as the average time of any one of steps 8, 11, or 15 (depending on whether the up peak has just started or is well established) divided by the number of cars available to the group so as to derive the average interval figure as the estimated rate at which cars will be dispatched if left to their own devices. In test 19, the average estimated interval is compared against some maximum predetermined dispatching interval, which may be on the order of 30 seconds between cars, and if it exceeds the maximum, it is forced in a step 20 to be equal to the predetermined maximum. And then the subroutine of FIG. 8 returns to step 9 of the up peak routine in FIG. 7. FIG. 9 indicates the other subroutine called for by the up peak routine in FIG. 7 which consists of the calculated interval routine which is reached through an entry point 1 in FIG. 9. A test 2 determines if the map of cars which are being dispatched with a load is all zeros. If so, the car under consideration which is now being dispatched for which a dispatch interval to be used in dispatching a subsequent car is being calculated, is determined to be dispatched because of clock dispatching rather than because the cars are at least half full. But if test 2 is negative, this means cars are being dispatched because they are full. In either case, depending upon the number of cars which are already at the lobby, the dispatching interval may be speeded up by a number of seconds which is reached in the Table as a function of whether the current car is being load or clock dispatched, and the number of cars at the lobby. For instance, if clock dispatching is involved, this means that cars are not getting half full within the dispatch interval which is being calculated. This indicates light demand and therefore if there are a lot of cars at the lobby, the dispatching of them should be speeded up so as not to deprive the rest of the building of cars unnecessarily. Thus, the speed up factors for cars which are dispatched without a half load are higher for any number of cars than those which are dispatched with at least a half load. This is indicated by FIG. 9 by a table lookup step 3. For whatever speed up value is selected in step 3, a step 4 provides the desired calculated interval as the average interval determined in the average interval subroutine minus the speed up factor determined in step 3. And then, the up peak routine continues at test 7 of FIG. 7 as described hereinbefore by means of a transfer point 5.

Figure 9:
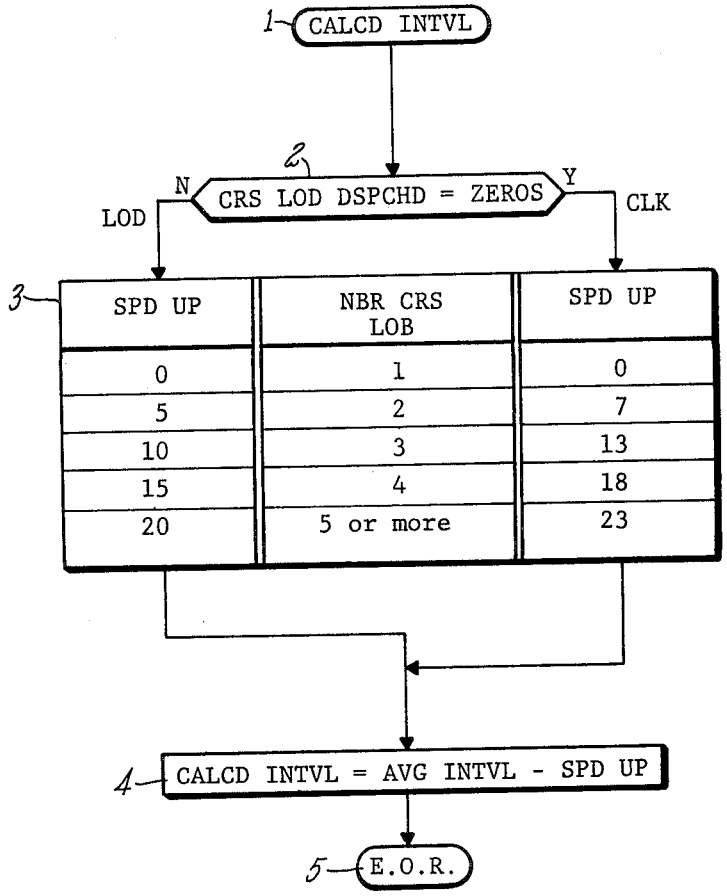
FIG. 9 is a logic flow diagram of a calculated interval subroutine for use in the up peak routine of FIGS. 5–7.

Referring jointly to FIGS. 7–9, and P6, it is seen that dispatching occurs as a consequence of the calculated interval which includes subtracting a speed up factor of FIG. 9 from the estimated average dispatch interval calculated in FIG. 8. If cars are not being half loaded within that interval, then FIG. 9 will utilize the larger speed-up factors so as to release the cars more quickly; thus, the variable interval utilized for dispatching is self-policing.

In FIG. 9, it should be noted that the various speed-up factors of between 5 and 23 seconds may be altered in any desired fashion to suit dispatching in any given installation in which the present invention is employed. Also, the average interval could be initially reduced in some fashion, such as by subtracting a fixed amount (eq 20 seconds) from it, or dividing it by some number (such as 4), and then adding increments to it in dependence on the number of cars fewer than five (or so) that are at the lobby. The round trip could be estimated in other fashions, and the dispatching interval could be provided by other methods. The significant point is that the invention provides a variable interval to accommodate wide variations in up-peak traffic.

Figure 10:
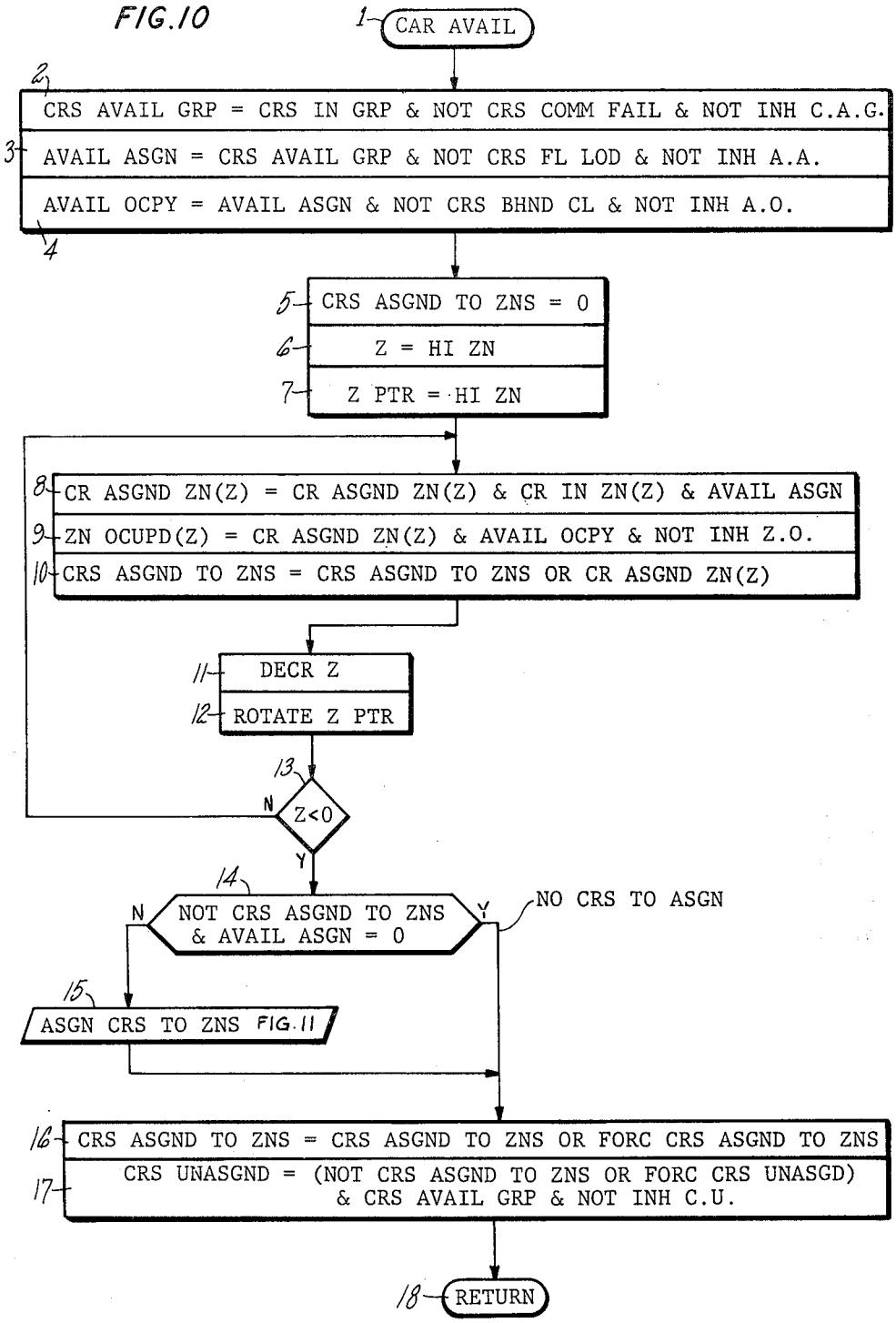

Referring now to FIG. 10, a car available routine is reached through an entry point 1. In step 2, a map of cars which are available to satisfy demand in the group (not disabled or on special service) is updated by ANDing the cars in group map (which is determined by each car telling the group that it is available and forming a map thereof), cars for which the group has not indicated a failure of the car to respond to it, thereby presuming communication failure with the car, and the complement of a map inhibiting cars available to the group. In step 3, a map of cars available for assignment is updated as the logical AND of maps indicating cars available to the group, the complement of a map of cars which are fully loaded (since a fully loaded car cannot be given further assignment) and the complement of a map inhibiting cars available for assignment. In step 4, a map of cars available for occupancy is updated as the logical AND of the map of cars available for assignment, the complement of a map of cars which are behind calls (in the event that such feature is employed during up peak or down peak zone assignments of the cars) and the complement of a map of inhibiting available for occupancy.

Step 5 of FIG. 10 resets a map of cars assigned to zones to zero. A zone number and a zone pointer are set to the highest zone of the building in steps 6 and 7. Then, in step 8, a map of cars assigned to the zone identified in steps 6 and 7 is updated by eliminating from it cars which are no longer in the zone or which have become unavailable for assignment. This is done by forming a logical AND of the map itself with a map of cars in the identified zone and the map of cars which are available for assignment. In step 9, the map of cars deemed to occupy a zone z is updated as the logical AND of the cars assigned to the zone, cars that are available for occupancy and cars not inhibited from occupying a zone. In step 10, the map of cars which are assigned to all zones put together is updated as the logical OR of itself with the map of cars assigned to the particular zone z under consideration. Then the next lower zone in sequence is identified by decrementing the zone number and rotating the zone pointer to a lower zone in steps 11 and 12 and if test 13 determines that the lowest zone has not yet been interrogated, steps 8 to 10 are repeated for each of the zones. When all of the zones have had their car status updates made in steps 8–10, a test 14 determines whether there are any cars available for assignment. If the complement of the map of cars assigned to zones and the map of cars available for assignment all equal zero, then there are no available, unassigned cars so that test 14 will be affirmative; but if step 14 is negative, then there is at least one available car for assignment so that an assign cars to zones subroutine 15 may be performed as is described hereinafter. In either event, a step 16 further updates the cars assigned to zones map by ORing itself with a forcing map of cars assigned to zones. This forcing map may be used where it is desired to force cars to the highest or lowest zone during down or up peak intervals, or the like. And, a map of cars not assigned is updated by ORing into it a map of forcing functions for unassigning cars, and logically ANDing that with the maps of cars available to the group and a map of cars not to be inhibited from the unassigned status map. Completion of the program of FIG. 10 causes the executive program to advance to a calls-to-cars or cars-to-calls program through a transfer point 18. Before considering that program, attention is now directed to the assign cars to zones subroutine 15 described hereinbefore with respect to FIG. 10.

The assign cars to zones subroutine is illustrated in FIG. 11, and reached through a transfer point 1. Steps 2 and 3 identify the highest numbered car in the building and test 4 determines if the particular car can be given a new assignment by ANDing the P pointer with the map of cars available for assignment and the complement of the map of cars already assigned to zones (in a fashion similar to test 14, FIG. 10 in general). If the car can be assigned, step 4 is affirmative and step 5 sets a zone equal to that where the car P is currently located as determined by the zone where car P number. Then, the determination is made as to whether the particular zone involved is already occupied in test 6. If the car is an already occupied zone, then this car cannot be assigned to that zone (there being another car already assigned there). So if step 6 is affirmative, no further operation is performed with respect to this particular car. But if the car is an unoccupied zone, test 6 is negative and test 7 will determine if the zone where the car is has a car assigned to it or not. The difference between a zone being occupied and having a car assigned to it is to be determined later. If the zone does not have a car assigned to it, test 7 will be negative and a step 8 will update the map of car identification assigned to the particular zone z by loading it with the P pointer. Then, the zone occupied map for the zone z will be updated by the P pointer if the car under consideration is within the map of cars available for occupancy of zones. In step 10, the map of all cars assigned to all zones is updated by ORing itself with the P pointer since car P has just become assigned to a zone. Then, the next lower numbered car in sequence is identified by decrementing the P number and rotating the P pointer in steps 11 and 12 and if a test 13 determines that the lowest car has not already been considered, the process is repeated for each car in sequence. When step 13 is affirmative, the subroutine is ended and will return to step 16 of the routine of FIG. 10 by means of a transfer point 14 (FIG. 11).

Referring now to FIG. 12, the calls-to-cars or cars-to-calls routine is reached through an entry point 1. A test 2 determines if up peak clock is involved by examining all the bits of the up peak cars map. If all the bits are zeros, test 2 is affirmative, indicating that up peak operation for assignment of cars to calls has not been initiated. On the other hand, if test 2 is negative, then up peak mode of assigning cars to calls is required and a step 3 will ensure that the calls-to-cars flag is reset, or zero, which will command zone operation in the routines 14–17 (FIG. 3) to handle the up peak. Similarly, if a test 3 determines that the map of down peak cars is not all zero, then test 3 will ensure that operation will proceed through the zone routines 14–17 of FIG. 3 in order to handle the up peak mode of operation. But if steps 2 and 4 are affirmative, then no peak operation is required.

In FIG. 12, a test 5 determines if there are any lobby cars by sensing whether the map of lobby cars is all zero. If it is not, then there is at least one car at the lobby so that a test 6 will determine whether there are any hall calls or not. This is done by examining a map of all hall calls to see if it is zero. If it is, there are no hall calls, so step 3 will call for assignment of cars to calls by ensuring that the calls-to-cars flag is reset. This will cause the zone routines 14–17 (FIG. 3) to come into play and create zone demands to park all of the cars in a distributed fashion among the zones of the building. But if test 5 is negative, there is no car at the lobby. Then, a test 7 will determine if there is a hall call which will result in calling a car to the lobby. If not, a test 8 will determine if any car calls have been indicated for the lobby. The result of tests 5–8, is if there is no car and no call for a car to bring one to the lobby, is that a step 9 will add a lobby call to a map of forcing up calls, which will create, within the group control, an indication that a lobby call has been made. This is not an actual lobby call, and no light will be indicated at the lobby, unless the particular implementation of the invention provides for such. But it will cause the hall call assignment routine 19 (FIG. 3) to assign a car to the lobby so that there will be a car at the lobby if the cars are all parked (by virtue of there being no peak periods and no hall calls to serve, as indicated by tests 2, 4, and 6). And, this provides additional favoritism to the lobby in the assignment of calls to cars, as is described more fully with respect to the hall call assignment routine 19 (FIG. 3), hereinafter. And, because an up call is forced by step 9, the program proceeding thereafter through test 6 will cause a negative response to test 6 because the lobby up call which has been forced by step 9 will prevent step 6 from being affirmative. This causes a step 10 to set the calls-to-cars flag which is tested in test 13 of FIG. 3 and causes the calls-to-cars assignment method to be utilized, as described briefly hereinbefore. Since test 6 will always be negative when there is a lobby up call unanswered, any pass through step 9 or affirmative result of test 7 could lead directly to step 10, bypassing test 6, is desired.

In FIG. 12, assuming a first pass has determined that tests 2, 4, and 5 are affirmative, test 7 is negative and test 8 is affirmative, so that a lobby call is forced in step 9, a subsequent pass through this routine (such as 200 milliseconds later) will probably find that test 5 is still affirmative, meaning no car has reached the lobby. But step 7 will also be affirmative indicating that there is a hall call to the lobby. Therefore, test 6 will again be negative. This will continue until a car reaches the lobby, and the call/car hall stop demand routine 20 (FIG. 3) resets the lobby hall call (as is described more fully with respect to FIG. 13 of the aforementioned Bittar application. At that time, test 5 will be negative because there will be a car at the lobby, and test 6 will be affirmative because the lobby call (having been answered) has been reset. With test 6 affirmative, step 3 will therefore cause reversion to the zone type of operation in which cars are assigned to calls. In any event, even when there are hall calls to be served, the routine of FIG. G3 will force calls for the lobby whenever there are no calls for the lobby and no cars at the lobby, so that the necessary preference for having lobby service will be effective. When the routine of FIG. 12 is completed, it returns to the main program of FIG. 3 through a return point 11.

Similarly, although the invention has been shown and described with respect to exemplary embodiments thereof, it should be understood by those skilled in the art that the foregoing and various other changes, omissions and additions may be made therein and thereto without departing from the spirit and the scope of the invention.

We claim:

1. An elevator system including a group of elevators for servicing a plurality of floor landings divided into contiguous zones in a building, comprising:

group controller means, including hall call means for registering calls for up and down service at each of side landings and signal processing means for exchanging signals with each of said elevators, responsive to said hall call means and to said signals indicative of conditions of said cars for determining the zone in which each car is located, for assigning cars to zones, for determining empty zones, for determining the floor of highest and lowest floor calls in each zone, for providing zone demand signals to the cars to command the cars to move upward or downward in the building to fill empty zones with unassigned cars and to cause assigned cars to reach floors in their respective zones where floor calls are registered, for determining up peak traffic conditions, for forcing cars from selected zones in the high end of the building to the main landing in response to up peak traffic conditions, for dispatching cars from the main landing at intervals in response to up peak traffic conditions and for issuing stop commands to each car in response to said signals indicative of conditions of said car indicating that the committable floor position of said car coincides with the floor landing of an empty zone or a floor call for which a zone demand signal has been provided to said car, for determining from car calls registered in any car dispatched from the main landing of the building in response to up peak traffic conditions the approximate round trip time required for such car to service such car calls and return to said main landing, and for varying the dispatching interval in accordance with said approximate round trip time;

each of said elevators including a car, car motion means for providing and arresting the motion of said car, means for registering car calls for service required by passengers therein, and a car controller means for providing signals indicative of conditions of said car, for controlling said car motion means to cause said car to move in a selected up or down direction and to stop in response to said signals indicative of conditions of said car and to signals received from said group controller means;

characterized by said signal processing means comprising means for determining the number of cars currently at said main landing and for altering said dispatching interval in accordance with the number of cars at said main landing.

2. An elevator system according to claim 1 further characterized by said signal processing means comprising means for determing the number of cars available to service up peak traffic, for providing an estimated dispatching interval capability as said approximate round trip time divided by said number of cars available to service up peak traffic, and for dispatching cars from said main landing at intervals dependent on said estimated dispatching interval capability.

3. An elevator system according to claim 2 further characterized by said signal processing means comprising means for determining the approximate round trip time for a plurality of cars most recently dispatched from said main landing and for providing said estimated dispatching interval capability in response to the average round trip time of said plurality of cars.

4. An elevator system according to claim 1 further characterized by said signal processing means comprising means for determining the number of cars currently at said main landing, for determining from said signals indicative of conditions of said cars, for each car dispatched from the main landing in response to up peak traffic conditions, whether such car is at least partially loaded, for reducing said dispatching interval by a first variable amount in dependence on the number of cars at said landing if such car is at partially loaded, and for reducing said dispatching interval by a second variable amount in dependence on the number of cars at said landing if such car is not at partially loaded, said second variable amount being greater than said first variable amount for a specific number of cars at said landing.

5. An elevator system according to any of claims 1, 2, 3, 4 further characterized by said signal processing means comprising means to establish a predetermined maximum dispatching interval, and for limiting said dispatching interval to not exceed said maximum dispatching interval.

* * * * *